US005894689A

United States Patent [19]

Turk

[11] Patent Number: 5,894,689

[45] Date of Patent: Apr. 20, 1999

[54] FREE FLOATING, SELF-LEVELING, INSTANT MOUNTING SIDE-SHIELD WING ATTACHMENTS FOR GENERAL UTILITY GRADING FLOWS

[76] Inventor: Roger E. Turk, S 12819 Cty Rd-I, Eleva, Wis. 54738

[21] Appl. No.: 08/892,441

[22] Filed: Jul. 14, 1997

Related U.S. Application Data

[ 60] Provisional application No. 60/022,224, Jul. 19, 1996.

[51] Int. Cl.[6] ..... E01H 5/06

[52] U.S. Cl. ..... 37/281; 37/280

[58] Field of Search ..... 37/241, 264, 266, 37/268, 274, 280, 281, 283

[56] References Cited

U.S. PATENT DOCUMENTS

| | | | |
|---|---|---|---|
| 3,805,424 | 4/1974 | Renahan | 37/42 VL |
| 4,145,825 | 3/1979 | Bertolino | 37/42 VL |
| 4,356,645 | 11/1982 | Hine et al. | 37/281 |
| 4,614,048 | 9/1986 | Melby | 37/280 |
| 4,741,116 | 5/1988 | Engle et al. | 37/280 |
| 4,962,600 | 10/1990 | Zellaha et al. | 37/280 |
| 5,148,617 | 9/1992 | Feller et al. | 37/281 |
| 5,285,588 | 2/1994 | Niemela et al. | 37/234 |
| 5,655,318 | 8/1997 | Daniels | 37/281 X |
| 5,758,728 | 6/1998 | Ragule | 172/281 X |

*Primary Examiner*—Heather Shackelford
*Attorney, Agent, or Firm*—Tipton L. Randall

[57] ABSTRACT

A side-shield wing attachment for a plow blade is disclosed. The planar wing blade is attached to a key element which rides in a vertical slot in a keyway assembly which is attached to the back side of a plow blade. The wing plate is held in about a perpendicular orientation with the end of the plow blade by a tensioning devises, such as a chain or the like, while the plow is in use. Optional stiffener bars and wing wear shoes are disclosed. The side-shield wing attachment is easily mounted or removed from the plow blade as desired.

12 Claims, 6 Drawing Sheets

FREE FLOATING, SELF-LEVELING, INSTANT MOUNTING SIDE-SHIELD WING ATTACHMENTS FOR GENERAL UTILITY GRADING FLOWS

This application claims priority from copending provisional application Ser. No. 60/022,224 filed Jul. 19, 1996.

BACKGROUND OF THE INVENTION

This invention relates to the design of free floating, self-leveling, instant mounting, side-shield wing attachments for general utility open faced grading plows. More particularly, while the present invention is represented by several illustrations as configured to a standard vehicle mounted open faced snow plow, it is envisioned that the invention is applicable to the to-grade plowing of any solid-like movable matrix such as earth, gravel, grain, etc. The purpose of the side-shield wing attachments for such a general utility open faced grading plow is to retain the material being moved within the full contact face of the plow and inhibit spillage of said material around the ends of the moving plow face as furrows. In short, the side-shield wing attachments render an open faced plow into a closed face scoop. It is acknowledged that single unit construction closed faced scoop plows are an ancient design of universal utilization in to-grade plowing. Likewise, various designs of side-shield wing attachments which can convert an open faced grading plow into the closed face scoop configuration are commercially available. However, the features which render this invention unique and non-obvious are the presence of side-shield wing attachments that are free-floating and self-leveling relative to the cutting edge of the plow. Thus, vertical movement of the wing attachment is facilitated by means of a key mechanism which is free floating in a keyway mounted to the back of the plow face. In this fashion, the wing attachment can lift and reset itself into proper alignment with the surface grade upon contact with a rigid obstruction present in the surface being plowed, such as a curb. Moreover, the free floating design allows the side-shield wing to drop below the level of the plow cutting edge when a negative grade is encountered. In the absence of such a free floating and self-leveling design, temporary side-shield wing attachments are prone to excessive mechanical stress and breakage upon contact with rigid obstructions on the grade, and moreover, do not adjust to a negative grade. The alternative is to utilize a single unit closed face scoop plow of very robust construction. However, the closed face scoop plow design with permanent side wings is limited in its utility to only straight-on directional plowing. Secondly, a robust closed face scoop design usually adds disadvantageous excessive weight to the plow assembly. The advantage of an open faced plow design is that the absence of the side-shield wing attachment, the plow face may be set at an angle and spillage from the trailing open end of the plow allows for furrow angle plowing of the movable matrix. This is a common and usual practice in the removal of snow from a large surface by repeated displacement of the furrow through consecutive passage of the plow at an angle to the previously laid furrow. The present design allows for the instant mounting or demounting of the attachments by simply detaching a tension chain from a chain hook adapter and lifting the side-shield wing from its keyway adapter. Thus, the best utility features of both an open faced and closed face scoop plow are immediately realized as the task demands.

Some of the patents relating to applicant's invention include U.S. Pat. No. 3,805,424 in which Renahan discloses a snow plow wing which raises or retracts by means of a single hydraulic cylinder.

Bertolino in U.S. Pat. No. 4,145,825 describes retractable plow wings pivotally mounted on a plow blade.

In U.S. Pat. No. 4,356,645 Hine et al. disclose a plow blade with wing blades adjustable with motors and hydraulics.

Melby in U.S. Pat. No. 4,614,048 describes a plow wing portion pivotally adjustable by hydraulic means.

In U.S. Pat. No. 4,741,116 Engle et al. disclose a plow wing assembly fastened in a fixed orientation to a plow blade.

Zellaha et al. in U.S. Pat. No. 4,962,600 describe a shear pin hinged plow wing assembly for a plow blade.

In U.S. Pat. No. 5,148,617 Feller et al. disclose pivotally mounted wing blades for a plow blade.

Niemela et al. in U.S. Pat. No. 5,285,588 describe a plow blade with blade wings pivotally mounted at each end which adjust by mechanical or hydraulic means.

None of these inventions disclose or suggest applicant's invention described in detail below.

SUMMARY OF THE INVENTION

The invention is a removable, self-leveling side-shield wing attachment for a plow blade, the blade having front and rear sides, a top edge and a bottom cutting edge. The attachment comprises a generally rectangular planar wing plate element with top and bottom edges and first and second vertical edges. A key mount element is positioned perpendicular to the wing plate and fastened to the plate at the first vertical edge near the top edged of the wing plate. A rectangular key element is oriented perpendicular to the key mount element and fastened near one end thereto. The key element is positioned parallel to and overlapping the wing plate element, with the key element extending from near the top edge of the wing plate to near the bottom edge of the wing plate. A keyway assembly comprises a generally rectangular U-shaped portion with open top and bottom ends. The U-shaped portion is fastened to a mounting plate element larger than the U-shaped portion and thereby forms an open ended rectangular slot. The keyway assembly is secured through the mounting plate to the rear side of the plow blade near the bottom edge, producing a vertical orientation of the rectangular slot. The keyway assembly and open ended slot therein is sized to reversibly accept the key element from the open top end. The end of the key element entering the slot may be tapered for easier entry thereto. The keyway assembly is positioned on the rear said of the plow blade such that the wing plate, attached to the key element by the key mount element, is positioned in close proximity to an end of the plow blade and generally perpendicular thereto, with the key element inserted into the vertical open top slot of the keyway assembly. A tensioning means between the wing plate and the plow blade maintains the wing plate in generally a perpendicular orientation relative to the blade during use.

While the enclosed Figures are drawn to scale for a standard eight foot truck mounted plow, precise specifications are not set forth. Indeed, the design is scaleable to open faced plows of any size.

DETAILED DESCRIPTION OF THE PREFERRED EMBODIMENTS

Figure 3:
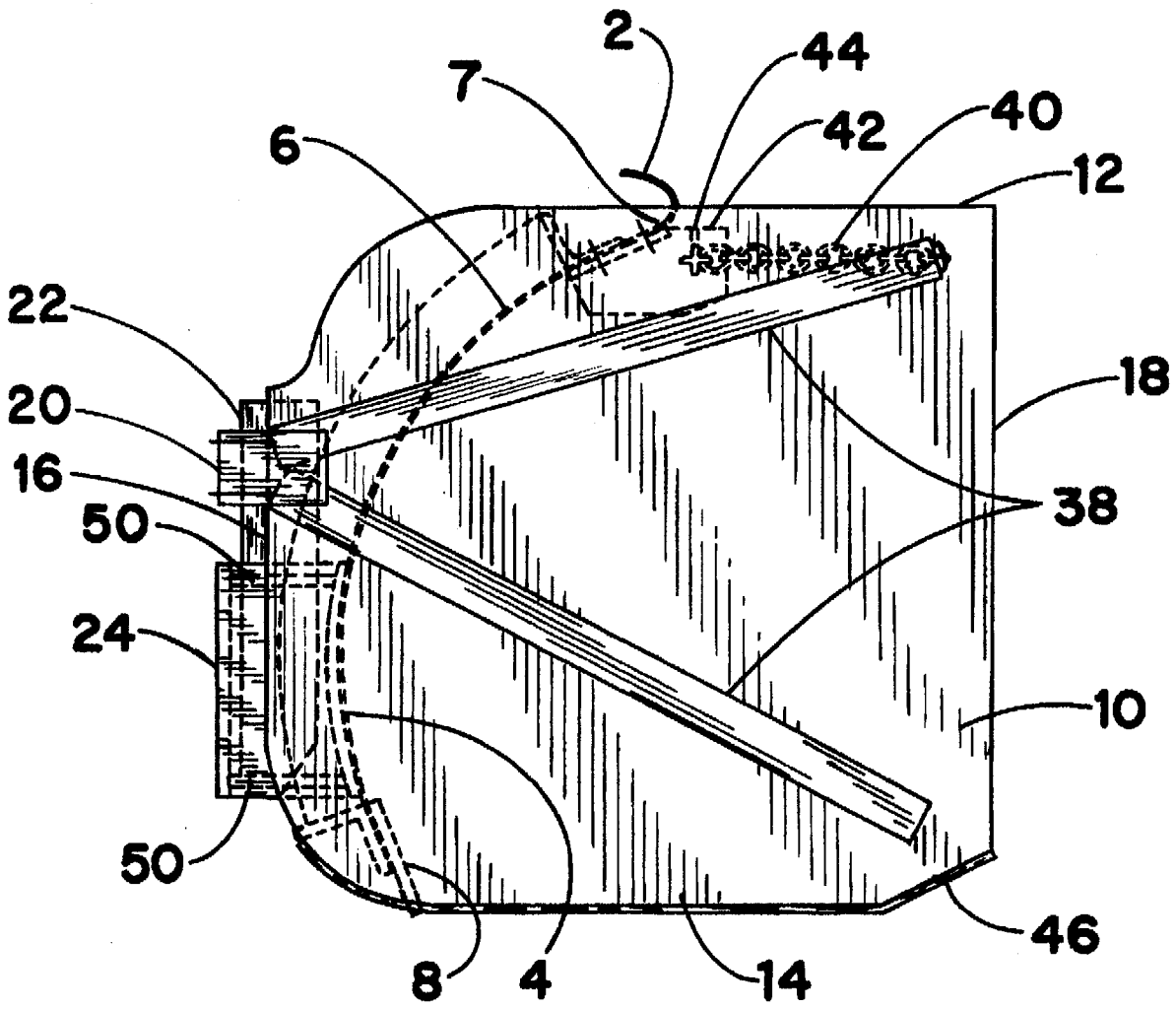
FIG. 3 duplicates the topographical perspective of the side-shield attachment.
Figure 4:
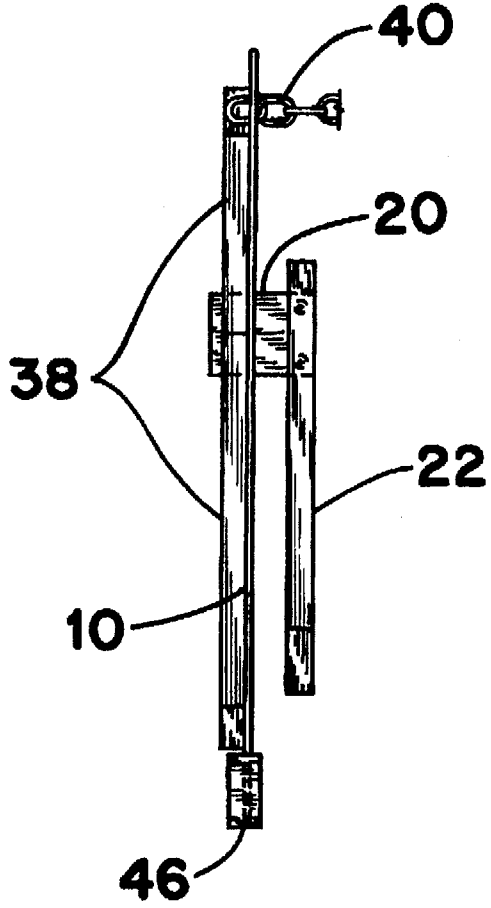
FIG. 4 shows the frontal end-on view of the attachment along with the tension chain assembly.

The invention is a removable, self-leveling, side-shield wing attachment for a plow blade 2 with front 4 and rear 6 sides, with a top edge 7 and a bottom cutting edge 8. The attachment comprises a generally rectangular planar wing plate element 10 with top 12 and bottom 14 edges and first 16 and second 18 vertical edges. A key mount element 20 is positioned perpendicular to the wing plate 10 and fastened to the plate at the first vertical edge 16 near the top edge 12 of the wing plate. The key mount element 20, best seen in FIG. 3, is approximately L-shaped in cross section with legs 21A and 21B. Leg 21B has a notch 21C on the inside at the end of that leg. The wing plate 10 is fastened to the inside of leg 21A preferably by welding thereto. A rectangular key element 22 is oriented perpendicular to the key mount element 20 and fastened near one end at the notch 21C at the end of the leg 21B. The key element 22 is positioned parallel to and overlapping the wing plate element 10, with the key element extending from near the top edge 12 of the wing plate to near the bottom edge 14 of the wing plate.

Various other configurations for the key mount element 20 can be envisioned. The wing plate 10 might be fastened to the outside of leg 21A or the notch 21C may be absent with the key element 22 fastened at the end of leg 21B. The only requirement for the key mount element 20 is that it securely fastens the wing plate 10 and key element 22 in parallel and overlapping orientation as described above.

A keyway assembly 24 comprises a generally U-shaped portion 26 with open top 28 and bottom 30 ends in combination with a mounting plate element 32. The U-shaped portion is fastened to the mounting plate element 32 which is larger than the U-shaped portion and thereby forms an open ended rectangular slot 34. The keyway assembly 24 is secured through the mounting plate portion 32 to the rear side 6 of the plow blade near the bottom edge 8, producing a vertical orientation of the rectangular slot 34. The keyway assembly 24 and open ended slot 34 therein is sized to reversibly accept the key element 22 from the open top end. The end of the key element 22 entering the slot may be tapered as shown in the Figures for easier entry thereto. The keyway assembly 24 is positioned on the rear side 6 of the flow blade such that the wing plate 10, attached to the key element 22 by the key mount element 20, is positioned in close proximity to an end of the plow blade and generally perpendicular thereto, with the key element 22 inserted into the vertical open top slot 34 of the keyway assembly 24. A tensioning means 36 between the wing plate 10 and the plow blade 2 maintains the wing plate 10 in generally a perpendicular orientation relative to the blade 2 during use.

Figure 1:
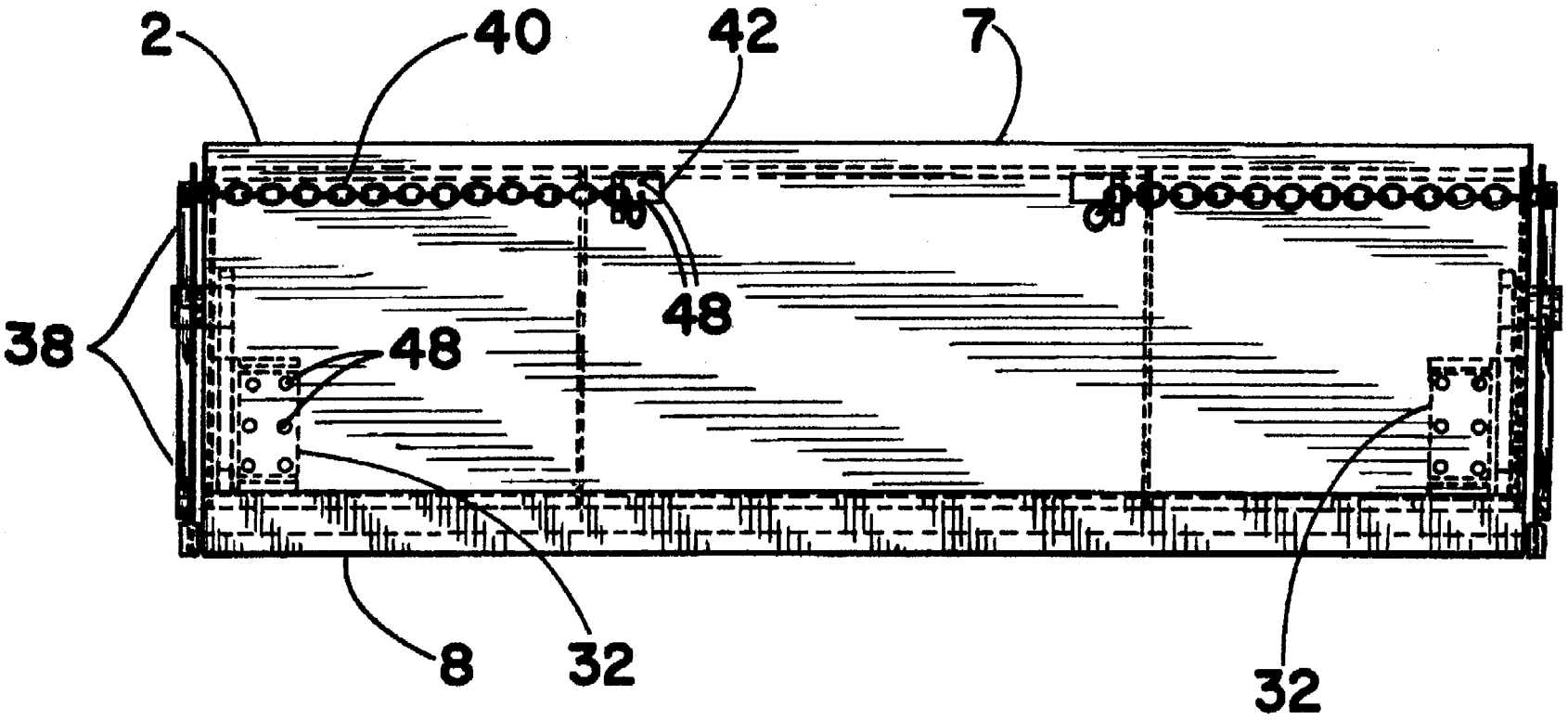
FIG. 1 illustrates the full frontal view of the side-shield wing attachments mounted to a typical eight foot snow plow.
Figure 2:
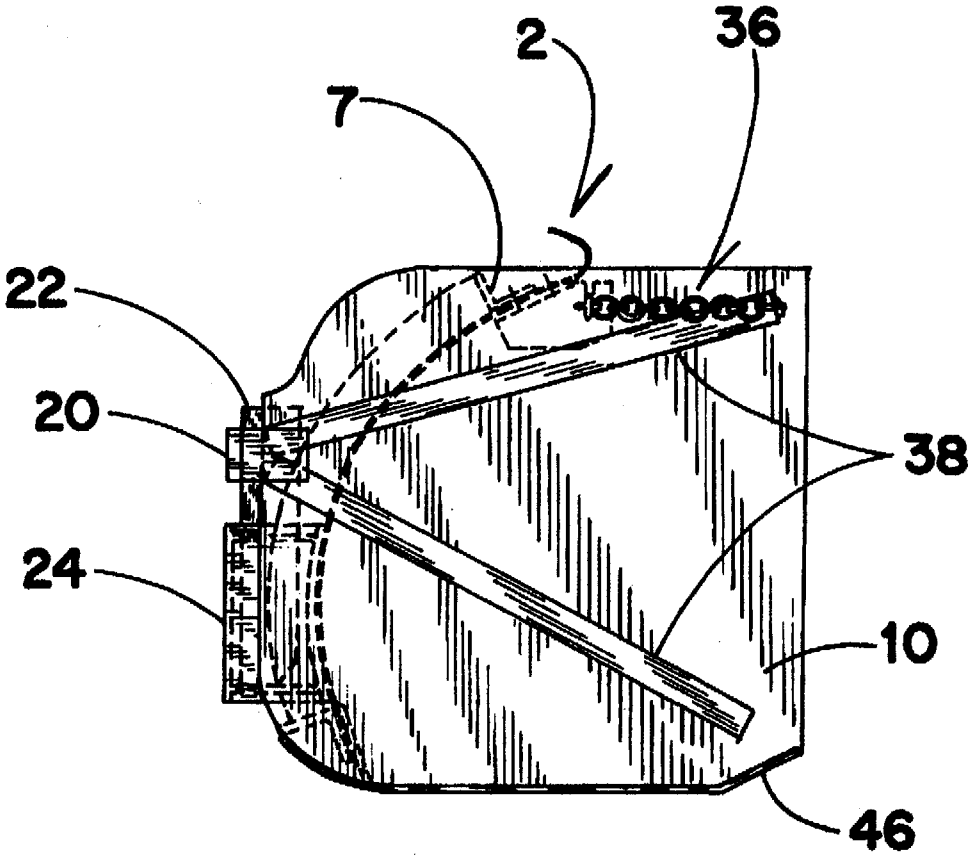
FIG. 2 is a right side topographical perspective of the mounted attachment.
Figure 6:
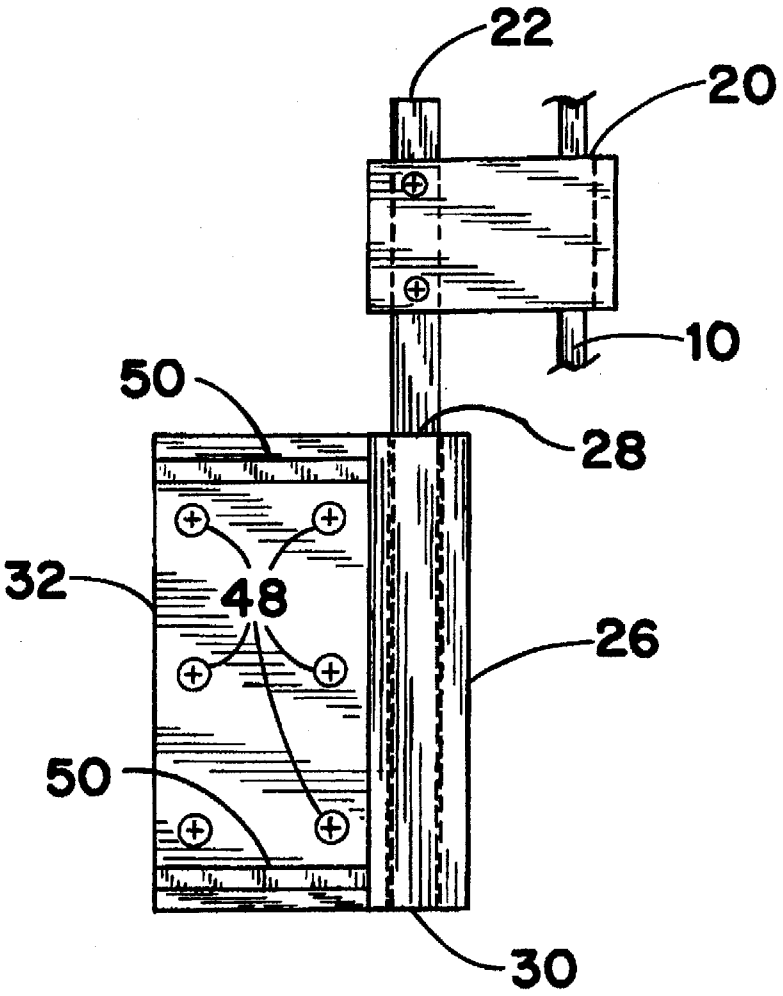
FIG. 5, 6, 7 and 8 illustrate left, rear, right and top perspective views respectively of the critical key/keyway mounting assembly.
Figure 5:
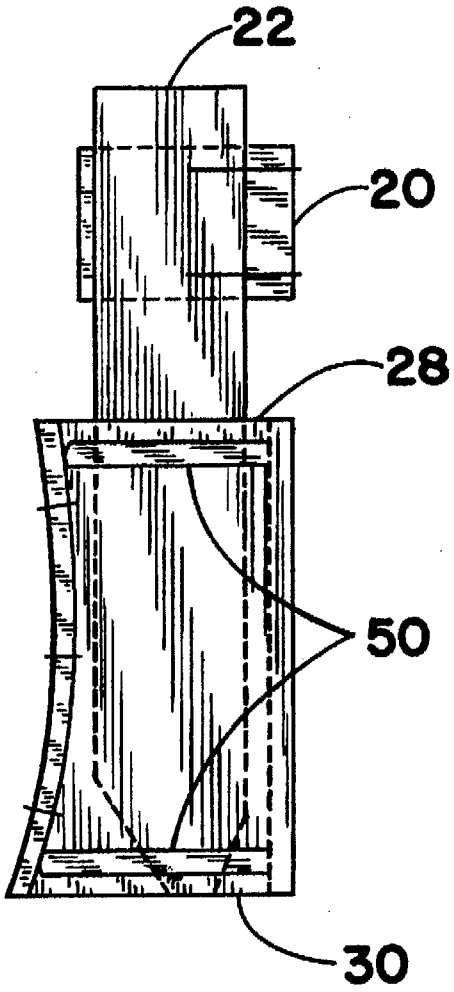
Figure 8:
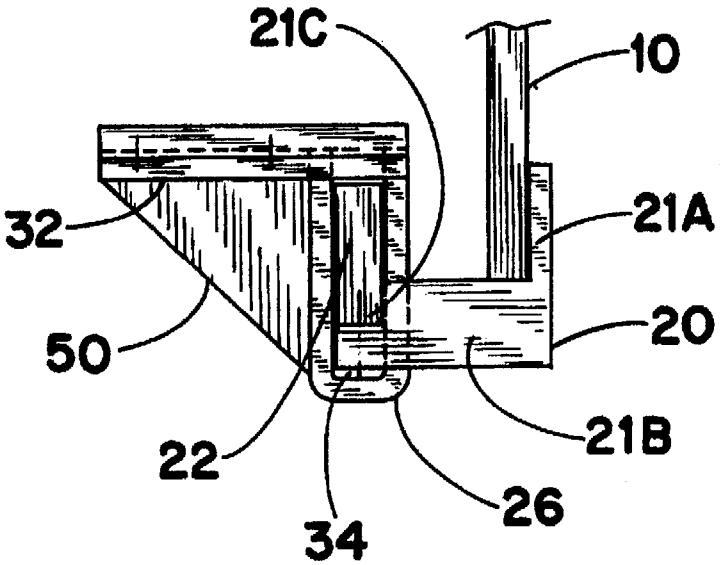
Figure 7:
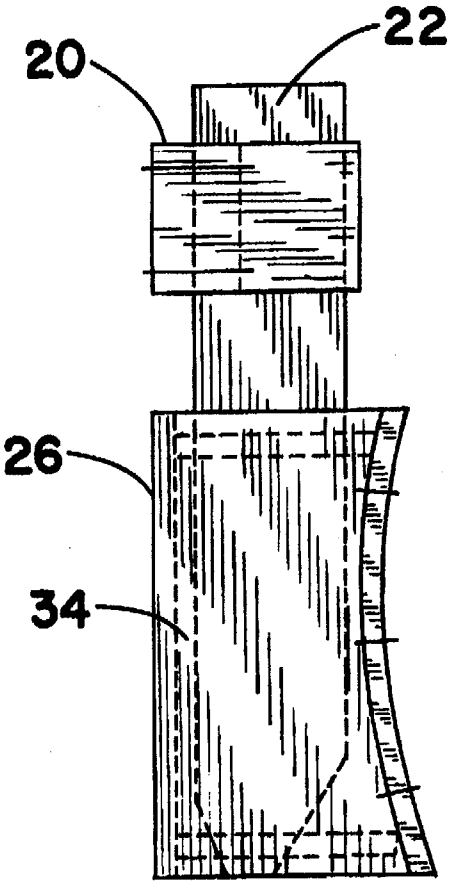

Construction specifications can be highly optional with regard to gauge of steel employed. However, as shown and rendered into practice, the wing plate is preferably of 3/16 inch steel sheet. The wing plate may be reinforced with one or more stiffener bars 38 fastened to the plate surface opposite the plow face. The two stiffener bars 38, as shown in FIGS. 1, 2 and 3, extend from close to the point of attachment of the key mount element 20 on the wing plate first vertical edge 16, each extending toward an opposite corner of the wing plate 10. The stiffener bars and key element are preferably of 5/8 inch steel bar stock. The tensioning means 36 to hold the wing plate in place during use is preferably a chain 40 of suitable length, connected securely to the wing plate 10 near the top edge opposite the key mount attachment point and close to the end of one of the stiffener bars 38. The chain is secured to the plow blade by means of a chain hook plate 42 which contains a notch 44 which reversibly accepts and holds one link on the chain 40. The plow attachment hook notch plate 42 is constructed of both 3/8 inch and 1/4 inch steel stock. Other tensioning means include wires, ropes, cables or even rigid members of wood, plastic or metal, all suitably fastened between the wing plate and the plow blade. All other components, excepting the chain, are of 1/4 inch steel stock, including 1/4 inch hard faced steel stock for the wing wear shoe 46. The wing wear shoe 46 is attached to the bottom edge 14 of the wing plate and rides on the surface being plowed. The fabrication of all multi-component assemblies is by means of standard continuous bead arc welding techniques. FIGS. 1 and 6 depict the key attachment to the key mount 20 by means of recessed tapped bolts 48. Likewise, attachment of the keyway assembly 24 to the rear 6 of the plow blade through the keyway mounting plate 32 and the chain hook plate 42 to the top of the front 4 of the plow blade are also depicted utilizing bolts 48. However, all bolt attachments are optional and continuous bead welding attachment of components is preferred for durability. The sole advantage of utilizing bolts is for the convenient replacement of components in the event of mechanical failure. However, a season of continuous use testing of an all-weld assembled prototype for commercial snow plowing resulted in no mechanical failure of the welds.

Additional strength is provided in fastening the U-shaped portion 26 of the keyway assembly 24 to the keyway mounting plate 32 in the form of two triangular gussets 50. The gussets 50 are positioned mutually perpendicular to both the keyway mounting plate and the U-shaped portion 26 of the keyway assembly 24, with one fastened near the top and one fastened near the bottom of the U-shaped portion 26.

From the foregoing description, one skilled in the art can easily ascertain the essential characteristics of the invention and, without departing from the spirit and scope thereof, make various changes and modifications to adapt it to various uses.

I claim:

1. A removable, self-leveling side-shield wing attachment in combination with a plow blade, comprising:

(a) a plow blade having front and rear sides, a top edge and a bottom cutting edge;

(b) a wing attachment comprising;

(i) a generally rectangular planar wing plate element with top and bottom edges and first and second vertical edges;

(ii) a key mount element positioned perpendicular to said wing plate and fastened to said wing plate at said first vertical edge near said top edge of said wing plate;

(iii) a rectangular key element with first and second ends, said key element oriented perpendicular to said key mount element and fastened near said first end thereto, said key element positioned parallel to and overlapping said wing plate element, said key element positioned to extend from near said top edge of said wing plate to near said bottom edge of said wing plate;

(iv) a keyway assembly comprising a generally rectangular U-shaped portion with open top and bottom ends and a mounting plate element larger than said U-shaped portion, said U-shaped portion fastened to said mounting plate element thereby forming an open ended rectangular slot, said keyway assembly secured through said mounting plate element to said rear side of said plow blade near said bottom edge thereof, resulting in a vertical orientation of said rectangular slot, said keyway assembly and open ended slot therein sized to reversibly accept said key element from said open top end, said keyway assembly positioned on said rear side of said plow blade such that said wing plate, attached to said key element by said key mount element, is positioned in close proximity to an end of said plow blade and generally perpendicular thereto, with said key element inserted into said vertical open top slot of said keyway assembly; and (c) tensioning means between said wing plate element and said plow blade to maintain said wing plate in generally a perpendicular orientation relative to said blade during use.

2. A wing attachment according to claim 1 further comprising at least one stiffening bar fastened to said wing plate to provide reinforcement thereto.

3. A wing attachment according to claim 1 further comprising a wing wear shoe member fastened to said bottom edge of said wing plate providing longer service life thereto.

4. A wing attachment according to claim 1 further comprising a plurality of triangular gussets fastened between said U-shaped member and said mounting plate element, said gussets providing additional strength to said keyway assembly.

5. A wing attachment according to claim 1 wherein said tensioning means between said wing plate and said plow blade comprises a chain fastened to said wing plate near said top edge and opposite said key mount attachment point, and a chain hook plate with a notch to accept said chain therein, said chain hook plate attached to said top of said plow blade a selected distance from an end of said plow blade.

6. A wing attachment according to claim 1 wherein said second end of said key element is tapered for easy insertion into said rectangular slot of said keyway assembly.

7. A removable, self-leveling side-shield wing attachment in combination with a plow blade, comprising:

(a) a plow blade having front and rear sides, a top edge and a bottom cutting edge;

(b) a wing attachment comprising;

(i) a generally rectangular planar wing plate element with top and bottom edges and first and second vertical edges;

(ii) a key mount element positioned perpendicular to said wing plate and fastened to said wing plate at said first vertical edge near said top edge of said wing plate;

(iii) a rectangular key element with first and second ends, said key element oriented perpendicular to said key mount element and fastened near said first end thereto, said key element positioned parallel to and overlapping said wing plate element, said key element positioned to extend from near said top edge of said wing plate to near said bottom edge of said wing plate;

(iv) a keyway assembly comprising a generally rectangular U-shaped portion with open top and bottom ends and a mounting plate element larger than said U-shaped portion, said U-shaped portion fastened to said mounting plate element thereby forming an open ended rectangular slot, said keyway assembly secured through said mounting plate element to said rear side of said plow blade near said bottom edge thereof, resulting in a vertical orientation of said rectangular slot, said keyway assembly and open ended slot therein sized to reversibly accept said key element from said open top end, said keyway assembly positioned on said rear side of said plow blade such that said wing plate, attached to said key element by said key mount element, is positioned in close proximity to an end of said plow blade and generally perpendicular thereto, with said key element inserted into said vertical open top slot of said keyway assembly; and (c) a tensioning chain fastened to said wing plate element near said top edge and opposite said key mount attachment point, and a chain hook plate with a notch to accept said chain therein, said chain hook plate attached to said top of said plow blade a selected distance from an end of said plow blade.

8. A removable, self-leveling side-shield wing attachment for a plow blade, comprising:

a) a generally rectangular planar wing plate element with top and bottom edges and first and second vertical edges;

b) a key mount element positioned perpendicular to said wing plate element and fastened to said wing plate element at said first vertical edge near said top edge of said wing plate element;

c) a rectangular key element with first and second ends, said key element oriented perpendicular to said key mount element and fastened near said first end thereto, said key element positioned parallel to and overlapping said wing plate element, said key element positioned to extend from near said top edge of said wing plate element to near said bottom edge of said wing plate element; and d) a keyway assembly comprising a generally rectangular U-shaped portion with open top and bottom ends and a mounting plate element larger than said U-shaped portion, said U-shaped portion fastened to said mounting plate element thereby forming an open ended rectangular slot, said keyway assembly adapted for fastening to a plow blade, said keyway assembly with open ended slot therein sized to reversibly accept said key element from said open top end, thereby allowing said key element and attached wing plate element to move vertically relative to said keyway assembly.

9. A wing attachment according to claim 8 further comprising at least one stiffening bar fastened to said wing plate element to provide reinforcement thereto.

10. A wing attachment according to claim 8 further comprising a wing wear shoe member fastened to said bottom edge of said wing plate providing longer service life thereto.

11. A wing attachment according to claim 8 further comprising a plurality of triangular gussets fastened between said U-shaped member and said mounting plate element, said gussets providing additional strength to said keyway assembly.

12. A wing attachment according to claim 8 wherein said second end of said key element is tapered for easy insertion into said rectangular slot of said keyway assembly.

* * * * *